United States Patent [19]

Bushman et al.

[11] Patent Number: 4,721,460

[45] Date of Patent: Jan. 26, 1988

[54] TILE FIRING SUPPORT STRUCTURE

[75] Inventors: James D. Bushman, Pittsburgh; Richard K. Moffat, Eighty-four, both of Pa.

[73] Assignee: Swindell Dressler International Corporation, Pittsburgh, Pa.

[21] Appl. No.: 21,505

[22] Filed: Mar. 4, 1987

[51] Int. Cl.[4] ..... F27D 1/12; F27B 9/26

[52] U.S. Cl. ..... 432/241; 432/258; 432/259; 264/57

[58] Field of Search ..... 432/239, 241, 258, 259, 432/2; 264/57–59

[56] References Cited

U.S. PATENT DOCUMENTS

| | | | |
|---|---|---|---|
| Re. 18,402 | 3/1932 | Bebb | 432/259 |
| 1,665,631 | 4/1928 | Laschenski | 432/241 |
| 1,739,037 | 12/1929 | Louthan | 432/259 |
| 2,118,641 | 5/1938 | Diamond . | |
| 2,275,926 | 3/1942 | Smith | 432/241 |
| 2,537,145 | 1/1951 | Lovatt et al. . | |
| 2,738,564 | 3/1956 | Guinane | 432/258 |
| 3,169,295 | 2/1965 | Paspy . | |
| 3,756,581 | 9/1973 | Albertini . | |
| 4,153,164 | 5/1979 | Hofmeister . | |
| 4,462,798 | 7/1984 | Foster | 432/241 |
| 4,487,579 | 12/1984 | Irwin | 432/241 |
| 4,578,031 | 3/1986 | Johnson et al. | 432/241 |

*Primary Examiner*—Henry C. Yuen

*Attorney, Agent, or Firm*—Banner, Birch, McKie & Beckett

[57] ABSTRACT

An apparatus for supporting and conveying ceramic wall and floor tiles through a kiln is provided. The tile support structure is mounted on a kiln car having a structural base supported on rotatable wheels adapted to travel along a set of rails running through the kiln. The support structure includes refractory support posts with recrystallized silicon carbide cross-beams mounted thereon. Pairs of refractory rods are hung from the cross-beams. Each of the rods has a plurality of tile supports along its length for supporting a plurality of tiles between the pair of adjacent rods.

14 Claims, 7 Drawing Figures

TILE FIRING SUPPORT STRUCTURE

BACKGROUND OF THE INVENTION

1. Field of the Invention

The present invention relates generally to structures for supporting ceramic tile as the tile is conveyed through a firing kiln, and more particularly to such a support structure mounted on a kiln car which is adapted to travel along a set of rails running through a kiln.

2. Description of the Prior Art

As practiced in the art, ceramic wall and floor tile may be kiln fired in a number of ways depending upon the tile body and glaze compositions and upon the size of the tile. For example, tile having a size of about 6"×6" or larger is typically fired by conveying the tile through the kiln on a roller hearth. On the other hand, tile having a size below about 3"×3" is typically fired by conveying the tiles through the kiln on a full support slab.

For tiles having a size intermediate the two above mentioned ranges, refractory tile setters have typically been employed. U.S. Pat. No. 3,169,295 to Paspy describes one such tile setter which typically holds about 18–24 tiles. The green (unfired) tile is manually loaded into the setters and a number of loaded setters are placed on a deck of a kiln car. Because of the blocklike configuration of these tile setters, several levels of tile setters can be placed, one on top of another, up to about 4 or 5 levels of tile setters.

While this type of tile setter overcame the problem of tile warpage occurring in earlier tile support systems, they suffered from other drawbacks including the requirement for manual loading and unloading of the tile into and out of the tile setters, manual loading and unloading of the setters on and off of the kiln car as well as enclosing the tiles in a box-like structure. U.S. Pat. No. 3,756,581 discloses another tile setter which also has this enclosed structure. The closed box-like structure limits the amount of air flow passing over the tiles and effectively lengthens the tile firing cycle in the kiln. The longer firing cycle translates into higher kiln fuel consumption per unit number of tiles produced.

In response to these defficiencies in the art, U.S. Pat. No. 4,462,798 to Foster discloses a more open support structure for the firing of ware of variable size. This patent utilizes large shelf slabs for supporting the ware so that ware having varied sizes and shapes, including over-sized ware, can be fired. Because of the large and heavy shelf slabs and the overall height of the ware support structure in the Foster patent, the structural members are made of recrystallized silicon carbide, a lightweight refractory material having exceptional strength, but a cost of about ten times that of conventional refractories. The apparatus disclosed in the Foster patent is accordingly very expensive to manufacture. In addition, because of the relatively heavy support blocks in which the silicon carbide posts are anchored, the overall kiln weight is somewhat high. This results in less efficient kiln operation since a greater portion of the heat from the kiln is absorbed by the mass of the kiln car and the support structure rather than the ware being fired.

Thus, it is an object of the present invention to provide a tile firing support structure, adapted to be mounted on a kiln car and having both a low mass and a relatively open structure, which minimizes the degree of contact between the support structure and the surface of the tile while maximizing the amount of free air flow around the tile thereby allowing the tile to be fire over a shorter firing cycle.

It is a further object of the invention to provide a tile firing support structure in which the tile density (i.e., the number of supported tiles per unit volume of space) is adjustable thereby allowing greater compatability with automated tile loading and unloading systems.

It is another important object to minimize the cost of the tile firing support structure by using lower cost refractory pieces which can be formed by punch pressing rather than by the expensive and time consuming casting and machining procedures used to make the prior art tile setters. It is also an object to minimize the cost of the tile firing support structure through judicious use of expensive refractory materials such as recrystallized silicon carbide as well as minimizing kiln fuel consumption per unit number of tiles produced.

SUMMARY OF THE INVENTION

These and other important objects are met by an apparatus for supporting and conveying a plurality of tiles through a kiln on a kiln car having a structual base supported on wheels which travel along a set of rails running through the kiln. The apparatus comprises a tile support structure including a pair of refractory support posts, extending vertically upwardly from the base of the kiln car, and supporting a refractory cross-beam. Preferably, at least two pairs of said refractory support posts are provided, each pair of posts supporting a refractory girder with the cross-beams being mounted on the girders. A pair of refractory rods are vertically suspended from the cross-beam and spaced along the length thereof. Each of the rods has a plurality of tile supports along its length for supporting a plurality of tiles between the rods. The tile supports are positioned a vertical distance above the base of the kiln car thereby providing a substantially open firing between the supported tiles and the base. This space is used as a kiln burner firing space into which the hot combustion gases from the kiln fuel burners are injected.

Figure 1:
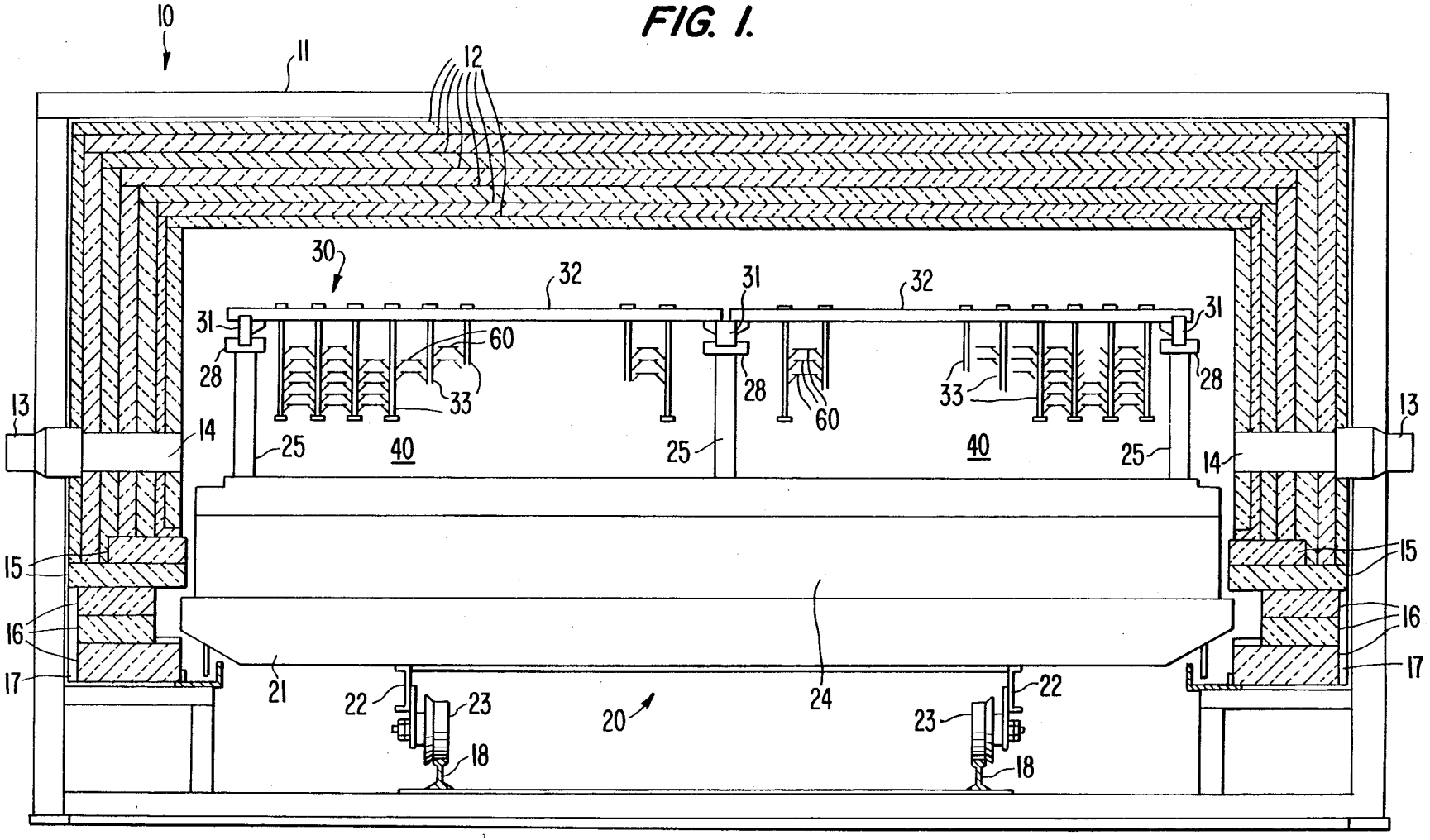
FIG. 1 is an end view of a kiln car, having a tile support structure of the present invention, shown traveling through a tunnel kiln drawn in section.

Although certain embodiments of the invention have been selected for illustration in the drawings, and although specific terminology will be resorted to in describing these embodiments in the detailed description here following, it will be appreciated by those skilled in the art that the scope of the invention is not limited to the specific embodiments described and illustrated but rather is defined by the appended claims.

DETAILED DESCRIPTION OF THE INVENTION

Referring to the drawings, wherein like reference numerals refer to the same elements in the several drawings, and referring particularly to FIG. 1, there is illustrated a cross-sectional view of one embodiment of a tunnel kiln 10. Other tunnel kiln designs can also be used in practicing the present invention. Kiln 10 typically has an overall width of about 11 feet and a height of about 6½ feet. Kiln 10 has an outer steel shell 11 comprising the roof and side walls of the kiln 10. Lining steel shell 11 are a plurality of insulation layers 12. Insulation layers 12 are preferably composed of low density ceramic fibers. Particularly preferred are low mass ceramic fiber insulation blankets and low mass ceramic fiber vacuum board. The individual layers typically have temperature ratings ranging up to about 2600° F. and thicknesses of about 1 to 2 inches. These low density ceramic fiber insulation materials allow the kiln 10 to be quickly and repeatedly started-up and shut-down in an economical manner, without risk of damaging the insulation. Although the present invention is not limited to kilns having these low density ceramic fiber insulating materials, they are greatly preferred from both efficiency and ease of operation standpoints.

Kiln 10 is provided with a plurality of burners 13, positioned along both sides of kiln 10. The number of burners provided in kiln 10 is mainly dependent upon the size of the kiln and the type of ceramic tile being fired. Of course, it is always possible to install an excess number of burners 13 in kiln 10 so that varied types, sizes and configurations of ceramic tiles may be fired in kiln 10. Burners 13 are typically high velocity burners which inject hot combustion gases into the kiln 10 interior at nozzle velocities on the other of about 200 miles per hour.

Burners 13 are positioned in openings 14 in the side walls of kiln 10 at a height just below the ceramic tile support structure 30 as will be described in more detail hereinafter.

Lining the lower side portions of kiln 10 are ceramic furnace insulation fire bricks 15 and 16. Bricks 15 and 16 typically have a temperature rating in the range of 2000°-2500° F. The lower bricks 16 are packed along their exterior side with loose insulation wool 17. Ceramic insulation fire bricks 15 and 16 have a much higher mass than insulation layers 12. While the low mass insulation layers 12 are preferred in the upper portion of the kiln adjacent the ceramic tile 60 due to their ability to quickly heat up and cool down, the higher mass bricks 15 and 16 are preferred in the lower portion of the kiln, which has a cross-sectional outline precisely dovetailing with the side configuration of kiln car 20, due to their increased dimensional stability and structural strength. By dovetailing bricks 15 and 16 with the heat barrier layer 24 and base 21 of kiln car 20, the amount of heat transferred to the steel superstructure of car 20 is greatly reduced.

Typically, kiln 10 operates at a temperature in the range of about 1950°-2250° F., although temperatures outside this range may be used in special situations.

Kiln car 20 travels along a set of rails 18 which run through kiln 10. Kiln car 20 comprises a base 21 having brackets 22 which secure flanged wheels 33 which run on rails 18. Base 21, brackets 22 and wheels 23 are all typically constructed of steel.

Positioned above base 21 is a heat barrier layer 24. Layer 24 may be a single layer or may be composed of a plurality of different layers. For example, layer 24 may incorporate ceramic fiber insulation materials, rigid ceramic heat insulating materials such as tiles or vermiculite in particle form. Layer 24 is preferably composed of low density ceramic fiber insulation materials which help to lower the overall weight of car 20.

Secured to base 21 and passing upwardly through layer 24 are a plurality of vertical refractory support posts 25. Posts 25 are typically composed of ceramic, and have a thin-walled circular cross-section. The wall thicknesses of the posts 25 are selected to provide adequate strength to carry the load, while at the same time restricting the area of the heat conduction path from the ceramic tile 60 being fired to the base 21.

While the tile support structure 30 is intended primarily to support ceramic wall and floor tile during firing, other types of ceramic articles having weights, shapes and dimensions suitable for support by structure 30 can also be fired on support structure 30. Accordingly, the term "tile" as used in the specification and claims encompasses these additional articles. The support structure 30 of the present invention is particularly useful in firing glazed ceramic tile. Tiles 60 are typically composed of dry-pressed clay having a moisture content of about 5-12%, although the present invention is not limited to any particular type of tile or tile body composition.

Figure 2:
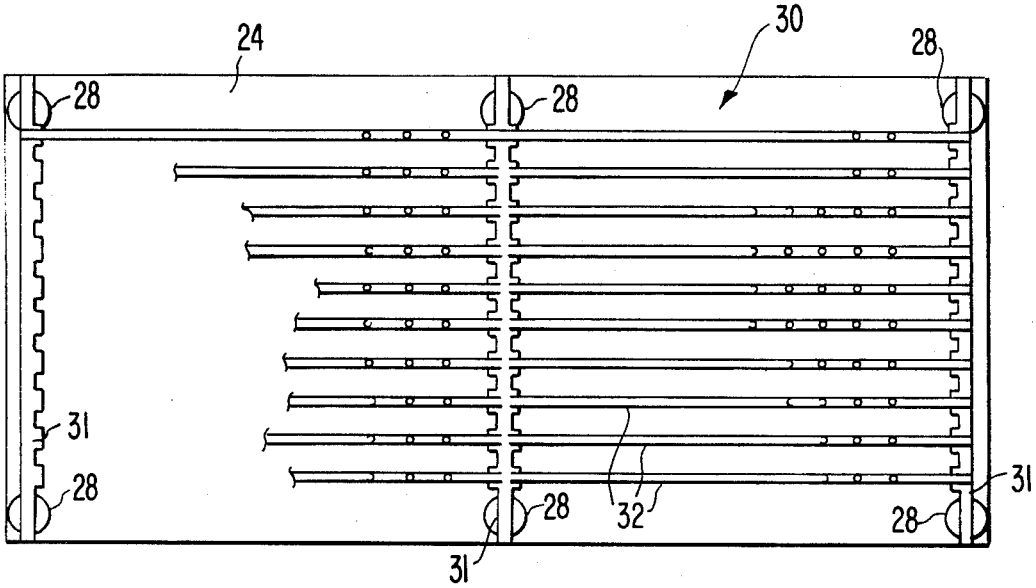
FIG. 2 is a top view of the kiln car and tile support structure shown in FIG. 1.
Figure 3:
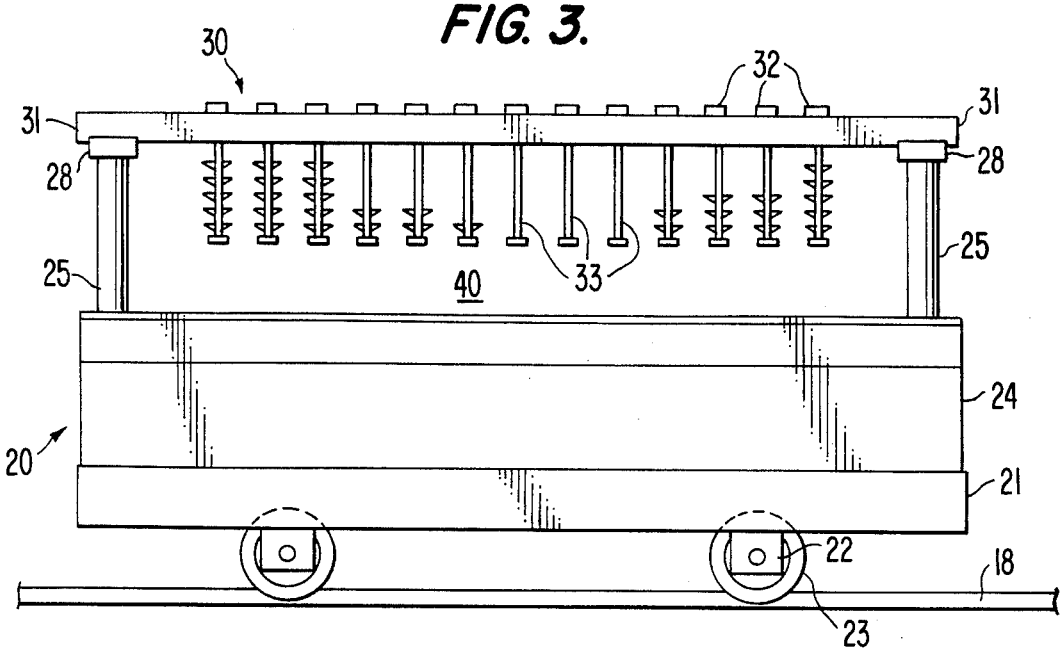
FIG. 3 is a side view of the kiln car and tile support structure shown in FIGS. 1 and 2.

As is clearly shown in the embodiment of FIGS. 1-3, six support posts 25 extend from base 21 of kiln car 20. Preferably, support posts 25 are composed of a cordierite-based refractory material (hereinafter referred to simply as "cordierite"). Cordierite is a magnesium aluminum metasilicate of low weight and high strength. The top end of support posts 25 are preferably provided with a cap 28, also preferably composed of cordierite.

As best shown in FIG. 2, girders 31 are mounted on caps 28 from adjacent support posts 25. In the embodiment illustrated in FIGS. 1-3, six support posts 25 are divided into three pairs of support posts, each pair of posts supporting a girder 31. Mounted across adjacent girders 31 are a plurality of substantially parallel cross-beams 32. Cross-beams 32 are preferably oriented so that their axes are perpendicular to the direction of travel of kiln car 20, as is best shown in FIGS. 2 and 3. Girders 31 and cross-beams 32 are preferably composed of a refractory material such as recrystallized silicon carbide or alumina which is able to remain stable at extremely high temperatures and which is readily slip cast to the desired shape and size as is disclosed in U.S. Pat. No. 2,964,823 incorporated herein by reference. Girders 31 and cross-beams 32 may be either solid or hollow, but are preferably of hollow rectangular cross-section when composed of recrystallized silicon carbide, as is clearly illustrated in FIGS. 6 and 7.

Posts 25, caps 28, girders 31 and cross-beams 32 are fastened together using recesses and interlocks as is well known to those skilled in the art.

Hung from each cross-beam 32 are a plurality of refractory rods 33. As is clearly shown in FIG. 1, rods 33 are preferably spaced an equal distance from one another along the length of each cross-beam 32. Rods 33 are preferably composed of cordierite. Each of the refractory rods 33 has a plurality of tile supports 50 spaced along its length as will be described in more detail hereinafter.

Because of the high velocity of the hot combustion gases exiting burners 13, it is important that support structure 30 present as little impedance to the hot combustion gas flow as possible. Otherwise there is a danger that the hot gas may be deflected within the kiln firing space resulting in uneven firing of tiles 60. As is clearly shown in FIGS. 1 and 3, the length of the suspended rods 33 is somewhat less than the vertical distance between the top of the heat barrier layer 24 and the cross-beams 32. This vertical distance is preferably about 6 to 9 inches. This in effect provides a substantially open firing space 40 into which the hot combustion gases from burners 13 are directed. Because of the suspended configuration of the tile support structure 30, there is little impedance to supplying the hot combustion gases across the entire upper surface of heat barrier layer 24. Accordingly, the ceramic tiles 60 which are positioned towards the interior of the support structure 30 are fired at substantially the same rate as the tiles 60 which are positioned adjacent the edges of the support structure 30.

Figure 7:
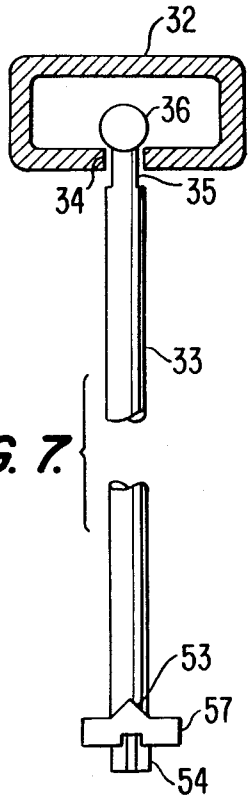
FIG. 7 is another side view of the cross-beam and vertically suspended rod shown in FIG. 6.
Figure 6:
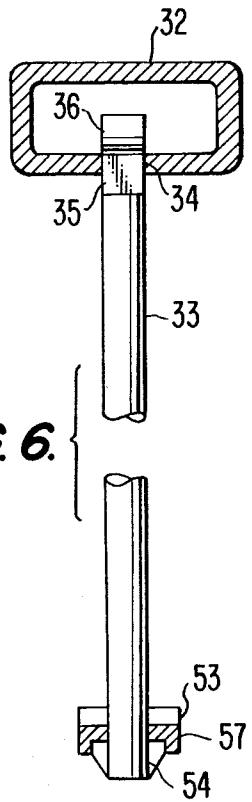
FIG. 6 is a side view, shown partly in section, of a cross-beam and vertically suspended refractory rod.

Referring now to FIGS. 6 and 7, there is illustrated one embodiment of a means for suspending rods 33 from cross-beams 32. In this embodiment, the upper end of rod 33 is provided with a flattended shank 35 and an enlarged cylindrical head 36. Openings 34 are provided in the bottom portion of the hollow cross-beam 32. The size of the opening 34 is made so that the head 36 can just be inserted through opening 34 while inthe orientation shown in FIG. 6. Once the head 36 is completely within the interior of cross-beam 32, the support rod 33 is simply twisted 90° to the orientation shown in FIG. 7. Due to the enlarged size of head 36, the head 36 is unable to pass back through opening 34 and the rod 33 is effectively suspended from cross-beam 32.

Figure 4:
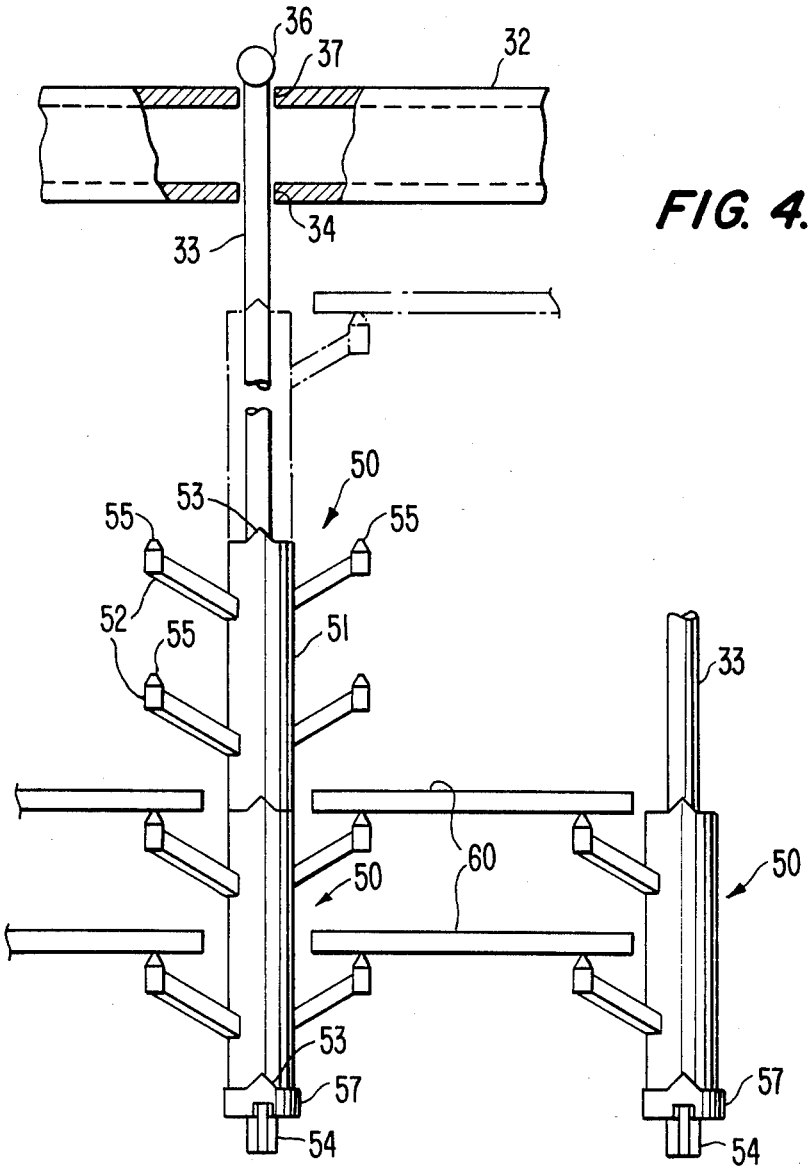
FIG. 4 is a side view, with parts shown in section, of a cross-beam and vertically suspended refractory rods.

An alternate means of suspending a refractory rod 33 from cross-beam 32 is illustrated in FIG. 4. In this embodiment, openings 34 and 37 are provided in both the bottom and top portions of the hollow cross-beam 32. The enlarged cylindrical head 36 is inserted through openings 34 and 37 and then twisted 90°. Other conventional means for suspending rods 33 from cross-beams 32 may also be used.

As is clearly shown in FIG. 4, a plurality of tile supports 50 are provided along the length of rod 33. Each of the tile supports 50 comprises a cylindrical member 51 having a plurality of generally radially extending arms 52. Each of the arms 52 preferably has a tile supporting ridge 55 at the end thereof. Ridges 55 provide "line" support for the tiles 60 during firing as opposed to "point" support from pins or "area" support from a shelf surface. Tile supports 50 are preferably composed of cordierite, a lower cost refractory material. Those skilled in the art will appreciate that cordierite supports 50 may be inexpensively manufactured using punch pressing techniques.

The vertical spacing between adjacent tiles 60 may be easily adjusted by simply changing the dimensions of tile supports 50. In addition, the horizontal spacing between adjacent, tiles may be adjusted simply by changing the spacing between addjacent cross-beams 32. In this way, the configuration and spacing of the supported tiles 60 may be easily adjusted to suit the particular needs of the tile loading and unloading equipment, for example.

The bore 58 of cylindrical member 51 has a diameter large enough to accomodate rod 33. Each of the cylindrical members 51 has a protruding key member 53 at one end and a corresponding key hole in the opposite end. In this way, a number of tile supports 50 may be positioned along the length of rod 33 with the key 53 of one tile support engaging the corresponding key hole of the adjacent tile support 50. In this way, a tile support 50 is prevented from rotating about rod 33 in relation to the adjacent tile supports 50.

The bottom end 54 of rod 33 is provided with a member 57 which may be a separate element fastened onto end 54 by appropriate means or may be slip cast as an integral part of rod 33. In addition, member 57 has a key member 53 which engages with a key hole in the lowermost tile support 50. In this way, both member 57 as well as all of the succeeding tile supports 50 are prevented from rotating about rod 33.

Figure 5:
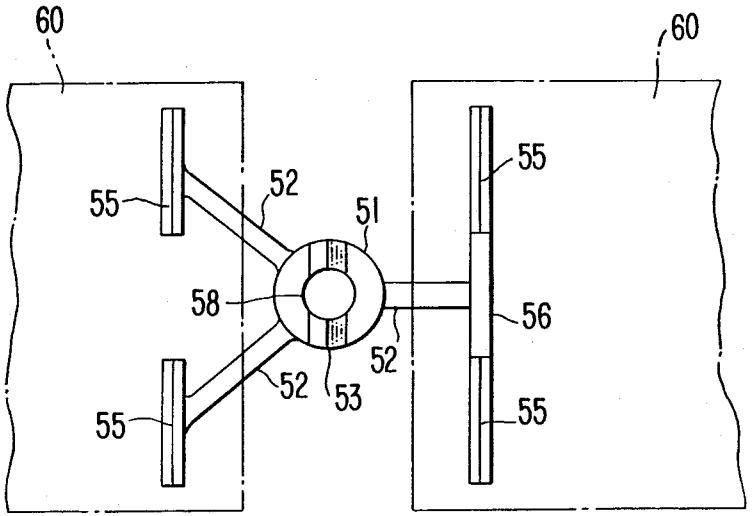
FIG. 5 is a top view showing two embodiments of a tile support.

FIG. 5 shows a tile support 50, similar to the supports 50 illustrated in FIG. 4. During firing of ceramic tile, the tiles are preferably supported on four supporting ridges 55. Each of the ridges 55 may be provided by a separate extension arm 52, as is illustrated on the left hand side of FIG. 5 wherein two separate extension arms 52 extend from cylindrical member 51. Alternatively, as shown on the right hand side of FIG. 5, a single extension arm 52 may extend from cylindrical member 51 and connect with a suitable U-shaped bracket 56 having two ridges 55 at the ends of the U. In either embodiment, two identical knife edge ridges 55 are presented to contact and support the underside of each end of tile 60.

As many other embodiments and modifications of the instant invention are possible, it is to be understood that the preferred embodiments disclosed and shown are for illustrative purposes only and that the invention includes all modifications and equivalents thereof falling within the scope of the appended claims.

We claim:

1. Apparatus for supporting, conveying and firing a plurality of tiles, comprising:

a tunnel kiln having a fuel burner in a sidewall thereof, said kiln having a set of rails running therethrough;

a kiln car having a structural base supported on wheels which travel along the set of rails;

a support structure mounted on the kiln car base including a pair of refractory support posts extending vertically upwardly from the base, said support structure supporting a refractory cross-beam;

a pair of refractory rods hung vertically from the cross-beam and spaced along the length thereof, each of the rods having a plurality of tile supports along the length thereof for supporting a plurality of tiles between the pair of rods, the vertically hung rods having bottom ends which are positioned a vertical distance above the base thereby providing a substantially open firing space between the tile supports and the base, the fuel burner being positioned to inject hot combustion gases into the open firing space as the kiln car travels along the set of rails and past the fuel burner.

2. The apparatus of claim 1, wherein the refractory cross-beams are at least partially composed of recrystallized silcon carbide.

3. The apparatus of claim 2, wherein the cross-beams are hollow.

4. The apparatus of claim 1, wherein the refractory rods are composed of cordierite.

5. The apparatus of claim 1, wherein the refractory support posts are composed of cordierite.

6. The apparatus of claim 5, wherein the refractory support posts are hollow thin-walled posts.

7. The apparatus of claim 1, wherein the support structure further includes a second pair of refractory support posts, each pair of support posts having a refractory girder mounted thereon, and a plurality of cross-beams mounted across said girders.

8. The apparatus of claim 7, wherein the girders are composed of recrystallized silicon carbide.

9. The apparatus of claim 7, wherein the plurality of cross-beams are substantially parallel to one another.

10. The apparatus of claim 9, wherein the axes of the cross-beams are substantially perpendicular to the direction of travel of the kiln car.

11. The apparatus of claim 1, wherein a plurality of pairs of refractory rods are suspended from the cross-beam.

12. The apparatus of claim 7, wherein each of the cross-beams have a plurality of pairs of refractory rods suspended therefrom.

13. The apparatus of claim 1, wherein the tiles comprise ceramic tiles.

14. The apparatus of claim 13, wherein the tiles are selected from glazed ceramic wall and floor tiles.

* * * * *